US006085485A

United States Patent [19]

Murdock

[11] Patent Number: 6,085,485

[45] Date of Patent: Jul. 11, 2000

[54] LOAD BEARING PRE-FABRICATED BUILDING CONSTRUCTION PANEL

[76] Inventor: Douglas G. Murdock, 1896 Stoneybrook Crt., Mississauga, Ontario, Canada, L5L 3W2

[21] Appl. No.: 08/988,697

[22] Filed: Dec. 11, 1997

[51] Int. Cl.[7] ..... E04C 2/292; E04C 2/32

[52] U.S. Cl. ..... 52/783.19; 52/783.11; 52/792.1; 52/793.11; 52/794.1; 52/798.1; 52/801.1; 52/588.1; 52/579; 52/309.7; 52/309.11; 52/309.14; 52/309.16; 52/591.4

[58] Field of Search ..... 52/783.11, 783.19, 52/792.1, 792.11, 793.11, 794.1, 798.1, 801.1, 801.11, 588.1, 579, 591.4, 271, 478, 537, 309.7, 309.9, 309.11, 309.14, 309.16, 630, 284

[56] References Cited

U.S. PATENT DOCUMENTS

| | | | |
|---|---|---|---|
| 1,679,914 | 8/1928 | Murray | 52/352 X |
| 3,290,845 | 12/1966 | Snyder | 52/588.1 X |
| 3,397,496 | 8/1968 | Sohns | 52/309.11 X |
| 3,399,503 | 9/1968 | Payne et al. | 52/588.1 X |
| 3,466,831 | 9/1969 | Lenoir | 52/478 X |
| 3,469,873 | 9/1969 | Glaros . | |
| 3,535,844 | 10/1970 | Glaros . | |
| 3,733,232 | 5/1973 | Payne | 52/783.11 |
| 3,872,636 | 3/1975 | Nicosia | 52/364 |
| 4,143,498 | 3/1979 | Martin, Jr. et al. . | |
| 4,283,897 | 8/1981 | Thompson . | |
| 4,295,304 | 10/1981 | Kim | 52/794.1 X |
| 4,463,533 | 8/1984 | Mullet | 52/478 |
| 4,546,590 | 10/1985 | Finch et al. . | |
| 4,575,981 | 3/1986 | Porter . | |
| 4,790,112 | 12/1988 | Wang . | |
| 4,941,304 | 7/1990 | Lewellin | 52/588.1 X |
| 5,228,257 | 7/1993 | Bowersox et al. . | |
| 5,285,609 | 2/1994 | Goad | 52/588.1 |
| 5,373,678 | 12/1994 | Hesser . | |
| 5,497,589 | 3/1996 | Porter . | |
| 5,509,242 | 4/1996 | Rechsteiner et al. . | |
| 5,625,999 | 5/1997 | Buzza et al. . | |
| 5,638,651 | 6/1997 | Ford . | |

FOREIGN PATENT DOCUMENTS

| | | | |
|---|---|---|---|
| 5-287856 | 11/1993 | Japan | 52/794.1 |

OTHER PUBLICATIONS

"Equipment, Materials and Methods—Wall and Roof Systems", Civil Engineering, p.118, Aug. 1963.

*Primary Examiner*—Laura A. Callo
*Attorney, Agent, or Firm*—Donald E. Hewson

[57] ABSTRACT

A load bearing pre-fabricated building construction panel comprises a main body portion of length "L", a thickness "T", and a width "W". A sheet metal outer skin is disposed substantially at the exterior of the main body portion and has opposed front and back portions adjoined by first and second side portions to form a substantially hollow core, with an insulative material disposed within the substantially hollow core. The building construction panels are connected one to a next substantially similarly oriented one in first side to second side relation. In a first embodiment, a first substantially rigid overlapping securing flange extends outwardly from the front portion of the construction panel past the first side portion, for fastening in overlapping relation to a first adjacent construction panel of similar orientation. A second substantially rigid overlapping securing flange extends outwardly from the back portion of the construction panel past the second side portion, for fastening in overlapping relation to a second adjacent construction panel of similar orientation. The building construction panel, including the first and second substantially rigid overlapping securing flanges, has an overall width "$W_o$". In a second embodiment, a rib member is secured to each of the front and back portions of the sheet metal outer skin so as to span therebetween in bracing relation, and extends substantially the length of the main body portion.

17 Claims, 3 Drawing Sheets

LOAD BEARING PRE-FABRICATED BUILDING CONSTRUCTION PANEL

FIELD OF THE INVENTION

This invention relates to load bearing pre-fabricated building construction panels that may be connected to a next substantially similarly oriented building construction panel in first side to second side relation, and more particularly to such building construction panels that fasten securely directly to adjacent similar building construction panels.

BACKGROUND OF THE INVENTION

In previous patented designs, there have been a large variety of modular building panels including pre-fabricated panels of many types. A common type of building panel includes a pair of planar surfaces consisting of sheet metal skins, interspersed with a polymer foam such as polyurethane or polystyrene; which results in a panel of light weight. Other panels have been designed with a honeycomb material within the planar skins, to create a lightweight panel with great insulation values.

There have been presented a wide variety of methods for the attachment between the pre-fabricated panels of these kinds. They generally involve a tongue and groove interlocking mechanism in which a tongue is introduced into a groove along the two coincident or abutting edges of two panels, and then locked together. Given that the tongue and groove are typically metal, techniques for a good seal against air flow have been designed including a variety of rubberized seals and caulks.

Typical patents of previously designed panels having a variety of panel-to-panel edge connection schemes for coincident or abutting edges, are described in the U.S. patents to Glaros (U.S. Pat. No. 3,535,844), wherein the tongue and groove connecting mechanism is used. A second patent to Glaros (U.S. Pat. No. 3,469,873) describes other means of connecting planar coincident panels. In the patent to Martin (U.S. Pat. No. 4,143,498) similar panels are interconnected with a connecting fastener clip which is bolted into the framework and which fits inside the groove of one of the coincident edge panels enabling a tongue to slide into it from the other coincident edged panel.

The Porter patent (U.S. Pat. No. 4,575,981) defines a roof panel connection mechanism in which coincident edge panels have off-setting edges which mesh to interlock the panels, which are then sealed through the use of threaded fasteners introduced through a pair of engaging tongues, one of each pair from each of the coincident or abutting edges of the two panels. The Finch patent (U.S. Pat. No. 4,546,590) describes the panel interconnections for a partition wall structure, in which the abutting edges of two panels are interconnected and secured by fasteners which are threaded through the interconnected edges.

The Thompson patent (U.S. Pat. No. 4,283,897) uses a snap action wall panel design, based on clips bolted to a support for holding a wall panel to a spaced supporting framework, and includes a sealing mechanism between coincident panel members. The Wang patent (U.S. Pat. No. 4,790,112) defines the attachment for two coincident and interconnected plastic planks to a supporting framework using a threaded fastener passing through the meshed tongues of the two abutting planks. The Bowersox patent (U.S. Pat. No. 5,228,257) describes a modular wall structure in which coincident panels with meshed tongues are linked together by a fastener which passes through the two tongues and caulks the abutting edged of the two panels, for a complete seal.

In reference to U.S. Pat. No. 5,373,678, it deals with panels with reinforced edge connection with male and female connectors. The basic structure of the panel is similar to all other panels where they used polystyrene as the core filler but rely solely on the abutting panels to supply the structural strength required.

SUMMARY OF THE INVENTION

In contrast to these prior systems for the construction and interconnection of modular panels, the present invention described herein in this patent, is specifically directed and designed as a structural load bearing insulating panel for structural walls, roofs and floor applications. Inside each panel running its entire length, is an innovative and unique continuous length structural steel "Z" or "C" section member; centered and attached to the insides of the two outer skins of the panels. This creates tremendous structural strength with high load bearing capabilities as well as rigidity in the structural panel as compared to all current alternative designs.

A further unique innovation in the panel system described in this patent is the fact that the top and bottom skins or steel sheaths of the panel are stitch welded together along their entire lengths, along doubly reinforced steel edges for strength. Additionally, the coincident edges of two of these panels are constructed with special overlapping connector extensions to each of the top and bottom sheaths or skins of each panel. These extension elements which run the continuous length of each of the abutting panels are securely fastened with self sealing threaded fasteners the full length of the coincident edges of the two abutting panels. By its very design, this method of interlocking coincident panel edges secures each panel to the body of the other panel, both along the upper and lower steel skin surfaces of each panel at an abutting edge and; not just to a tongue and groove element which could lack in structural load bearing integrity as in previous panel designs.

A structural wall panel section and/or a structural floor panel section includes two or more of these panels arranged in an edge to edge coincident formation, with each panel being connected securely along the entire length of each of the abutting panel. Each panel has upper and lower panel skins of steel, interspaced by a continuous member steel "Z" or "C" section centered and stitch welded to the inside surfaces of both the upper or top and lower or bottom skins of the panel, along its entire length. There may also be "I", "V", or "W" shaped sections. Also interspaced within this framework of upper and lower skins and "Z" or "C" section member, is the intermediate insulating and fire retardant core of foam polymer high density urethane.

Each of the upper and lower panel skins for a given panel has a skin return plate which gets stitch welded during production to the corresponding opposite inside surface of the other skin; that is the top or upper skin return plate which is stitch welded to the inner surface of the bottom or lower skin, while the lower or bottom skin return plate is stitch welded to the inner surface of the top or upper skin.

Each panel has at its top skin a specially rollformed and reinforced edge which extends beyond the closing end of the panel itself. This special element overlaps over the coincident top skin of an abutting edged panel and is fastened through this extension along the full length of the coincident panel edges, by threaded self sealing TEK fasteners. Each panel at its bottom skin has the bottom sheet folded back onto itself to create a rigid lap connector, which overlaps to the corresponding indented bottom skin edge of the abutting edged panel, and is securely attached through the multiple reinforced steel skins by threaded self sealing TEK fasteners. This design using an elongated reinforcing member at the upper abutting joint, and using a channel formed reinforced member to accommodate the bottom extension flange from the abutting bottom edge of the lower abutting joint, both of the same panel; creates a exceptionally strong link-lock mechanism for joining coincident panels into a load bearing structural wall, roof or a structural floor creation.

For each panel, the top or upper steel skin is corrugated for enhanced structural strength with the flange extensions to overlap a corrugated edge section of an abutting panel top. The lower skin section is flat with an indented edge along one bottom length and the reinforced elongated flange member extension along the other edge of this same panel. A plurality of threaded self fastening TEK members seals both the upper overlap joints and the lower indent-to-flange joints; passing through two layers of steel at the upper edge along its entire length, and passing through three layers of steel at the lower edge along its entire length.

Fasteners and angled steel elements are used to attach the panel sections, consisting of two or more individual panels, so as to form walls, roofs, and floors.

In accordance with one aspect of the present invention, there is provided a load bearing pre-fabricated building construction panel; wherein the building construction panels may be connected one to a next substantially similarly oriented one in first side to second side relation. The building construction panel comprises a main body portion of length "L", thickness "T", and width "W". A sheet metal outer skin is disposed substantially at the exterior of the main body portion and has opposed front and back portions adjoined by first and second side portions to form a substantially hollow core, with an insulative material disposed within the substantially hollow core. A first substantially rigid overlapping securing flange extends outwardly from the front portion of the construction panel past the first side portion, for fastening in overlapping relation to a first adjacent construction panel of similar orientation. A second substantially rigid overlapping securing flange extends outwardly from the back portion of the construction panel past the second side portion, for fastening in overlapping relation to a second adjacent construction panel of similar orientation. The building construction panel, including the first and second substantially rigid overlapping securing flanges, has an overall width "$W_o$".

Specific embodiments of the invention provide that the second substantially rigid overlapping securing flange is disposed substantially parallel to the back portion of the construction panel and further comprises an offset portion disposed along the length of the back portion of the construction panel to receive therein a second substantially rigid overlapping securing flange of the second adjacent construction panel.

Further provided is that the first substantially rigid overlapping securing flange may be disposed substantially parallel to the front portion of the construction panel. Also, the front portion of the construction panel may be corrugated, and the first substantially rigid overlapping securing flange would terminate in an angled lip portion to follow the corrugation of the first adjacent construction panel.

The opposed front and back portions may comprise first and second skin elements, respectively, with the first and second skin elements are secured together by stitch welding.

The first skin element may include the second side portion of the sheet metal outer skin and the second skin element may include the first side portion of the sheet metal outer skin, in which case the first side portion would terminate in an adjoinment flange oriented substantially parallel to the front portion and directed toward the second side portion, and the second side portion would terminate in an adjoinment flange oriented substantially parallel to the back portion and directed toward the first side portion.

Also, the second skin element includes the first and second side portions of the sheet metal outer skin, in which case the first side portion would terminate in an adjoinment flange substantially parallel to the front portion and directed toward the second side portion, and the second side portion would terminate in an adjoinment flange substantially parallel to the front portion and directed toward the first side portion.

The second substantially rigid overlapping securing flange may be formed by folding the second skin element onto itself.

The load bearing pre-fabricated building construction panel further comprises a rib member secured to each of the opposed front and back portions of the sheet metal outer skin so as to span therebetween in bracing relation, and extends substantially the length "L" of the main body portion and preferably extends the entire length of the main body portion. The rib member is of substantially constant cross-section along its length and the shape of the cross-section of the rib member is chosen from the group consisting of "Z"-shaped, "C"-shaped, "I"-shaped, "V"-shaped, and "W"-shaped.

A particular embodiment of the present invention provides a load bearing pre-fabricated building construction panel; wherein the building construction panels may be connected to a next substantially similarly oriented building construction panel in first side to second side relation. The building construction panel comprises a main body portion having length "L", thickness "T", and width "W". A sheet metal outer skin is disposed substantially at the exterior of the main body portion and having opposed front and back portions adjoined by first and second side portions to form a substantially hollow core, with an insulative material disposed within the substantially hollow core. A first substantially rigid overlapping securing flange extends outwardly from the front portion of the construction panel past the first side portion, for fastening in overlapping relation to a first adjacent construction panel of similar orientation. A second substantially rigid overlapping securing flange extends outwardly from the back portion of the construction panel past the second side portion, for fastening in overlapping relation to a second adjacent construction panel of similar orientation. The building construction panel, including the first and second substantially rigid overlapping securing flanges, has an overall width "$W_o$". The front portion and the second side portion of the sheet metal outer skin together comprise a first skin element and the back portion and the first side portion of the sheet metal outer skin comprise a second skin element. The first side portion terminates in an adjoinment flange oriented substantially parallel to the front portion and directed toward the second side portion, and the second side portion terminates in an adjoinment flange oriented substantially parallel to the back portion and directed toward the first side portion.

Another particular embodiment of the present invention provides a load bearing prefabricated building construction panel; wherein the building construction panels may be connected to a next substantially similarly oriented building construction panel in first side to second side relation. The building construction panel comprises a main body portion having length "L", thickness "T", and width "W". A sheet metal outer skin is disposed substantially at the exterior of the main body portion and has opposed front and back portions adjoined by first and second side portions to form a substantially hollow core, with an insulative material disposed within the substantially hollow core. A first substantially rigid overlapping securing flange extends outwardly from the front portion of the construction panel past the first side portion, for fastening in overlapping relation to a first adjacent construction panel of similar orientation. A second substantially rigid overlapping securing flange extends outwardly from the back portion of the construction panel past the second side portion, for fastening in overlapping relation to a second adjacent construction panel of similar orientation. The building construction panel, including the first and second substantially rigid overlapping securing flanges, has an overall width "$W_o$". The front portion of the sheet metal outer skin together comprise a first skin element and the back portion, the first side portion, and the second side portion of the sheet metal outer skin together comprise a second skin element. The first side portion terminates in an adjoinment flange substantially parallel to the front portion and directed toward the second side portion, and the second side portion terminates in an adjoinment flange substantially parallel to the front portion and directed toward the first side portion.

In accordance with another aspect of the present invention, there is provided a load bearing pre-fabricated building construction panel wherein the building construction panels are connected one to a next substantially similarly oriented one in first side to second side relation. The building construction panel comprises a main body portion of length "L", thickness "T", and width "W". A sheet metal outer skin is disposed substantially at the exterior of the main body portion and has opposed front and back portions adjoined by first and second side portions to form a substantially hollow core, with an insulative material disposed within the substantially hollow core. A rib member is secured to each of the front and back portions of the sheet metal outer skin so as to span therebetween in bracing relation, and extends substantially the length of the main body portion.

BRIEF DESCRIPTION OF THE DRAWINGS

The novel features which are believed to be characteristic of the present invention, as to its structure and use, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Referring to FIGS. 1 through 8, first and second preferred embodiments and an alternative embodiment of the load bearing pre-fabricated building construction panel of the present invention are shown, which embodiments of the building construction panel may be connected to a next substantially similarly oriented building construction panel in first side to right side relation to form a wall, a roof, a floor, or other structural section.

Figure 1:
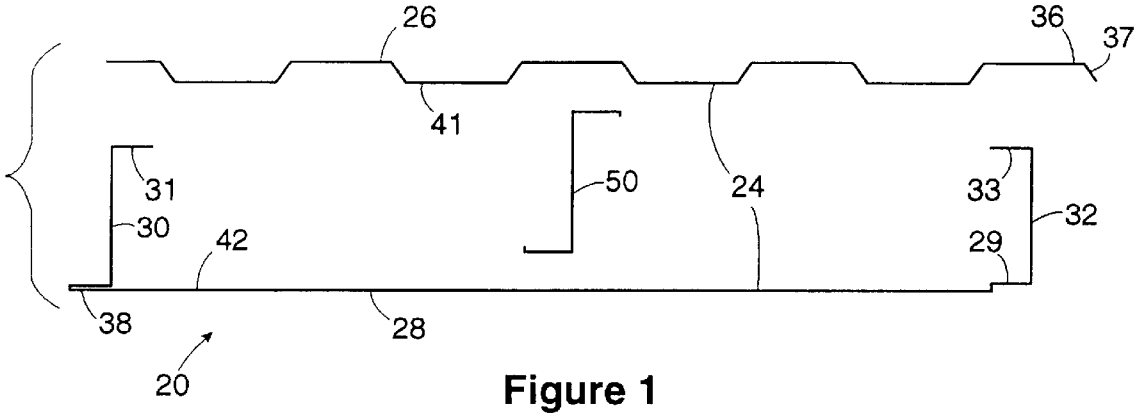
FIG. 1 is an exploded end view of a first preferred embodiment of the load bearing pre-fabricated building construction panel according to the present invention.
Figure 2:
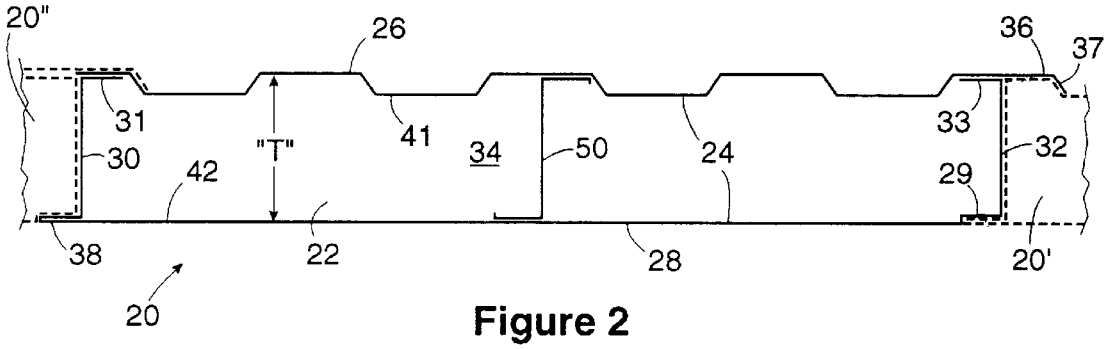
FIG. 2 is an end view of the load bearing pre-fabricated building construction panel of FIG. 1.
Figure 3:
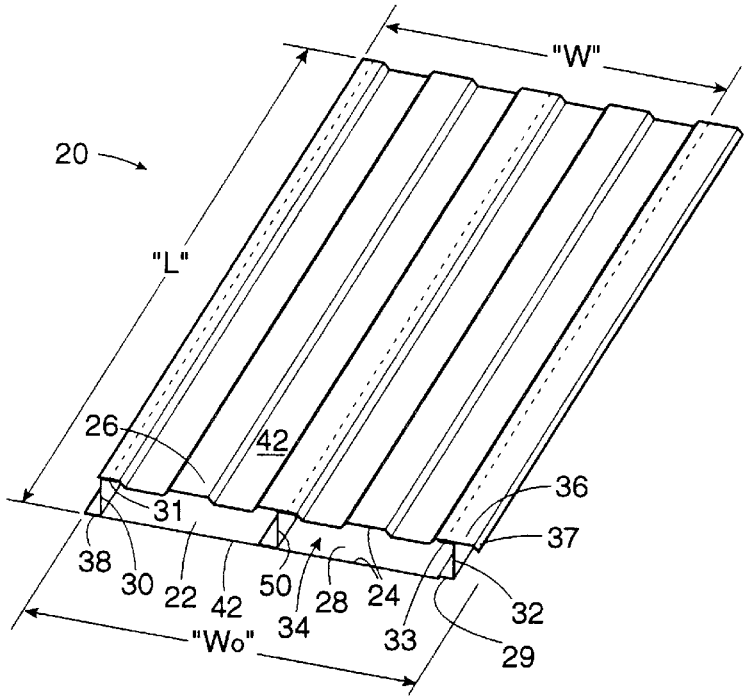
FIG. 3 is an isometric view from the end of the load bearing pre-fabricated building construction panel of FIG. 1.

Reference will now be made to FIGS. 1 through 3, which show a first preferred embodiment of the load bearing pre-fabricated building construction panel 20 of the present invention. The building construction panel 20 comprises a main body portion 22 having length "L", thickness "T", and width "W". A sheet metal outer skin 24 is disposed substantially at the exterior of the main body portion 22 and has opposed front and back portions 26,28 adjoined by first and second side portions 30,32 to form a substantially hollow core 34, with an insulative material disposed within the substantially hollow core 34. In the first preferred embodiments, the front portion 26 of the building construction panel 20 is corrugated so as to augment the structural strength of the building construction panel 20.

A first substantially rigid overlapping securing flange 36 extends outwardly from the front portion 26 of the construction panel 20 past the first side portion 30, for fastening in overlapping relation to a first adjacent construction panel of similar orientation. The first substantially rigid overlapping securing flange 36 is disposed substantially parallel to the front portion 26 of the construction panel 20. If the front portion 26 of the building construction panel 20 is corrugated, the first substantially rigid overlapping securing flange 36 terminates in an angled lip portion 37 to follow the corrugation of the first adjacent construction panel 20'.

A second substantially rigid overlapping securing flange 38 extends outwardly from the back portion 28 of the construction panel 20 past the second side portion 32, for fastening in overlapping relation to a second adjacent construction panel of similar orientation. The second substantially rigid overlapping securing flange 38 is preferably disposed substantially parallel to the back portion 28 of the construction panel 20 and may be formed by folding the second skin element onto itself. The second substantially rigid overlapping securing flange 38 further comprises an offset portion 29 disposed along the length of the back portion 28 of the construction panel 20 to receive therein a second substantially rigid overlapping securing flange 38 of the second adjacent construction panel 20".

The building construction panel 20, including the first and second substantially rigid overlapping securing flanges 36,38, has an overall width "W.".

In the first and second preferred embodiments, the opposed front and back portions 26,28 comprise first and second skin elements 41,42, respectively. The first and second skin elements 41,42 may be secured together by stitch welding, or possibly by an appropriate adhesive, which may help provide a thermal barrier, or by any other suitable means.

In the first of the building construction panel 20, the second skin element 42 includes the first and second side portions 30,32 of the sheet metal outer skin 24. The first side portion 30 terminates in an adjoinment flange 31 substantially parallel to the front portion 26 and directed back towards the second side portion 32, and the second side portion 32 terminates in an adjoinment flange 33 substantially parallel to the front portion 26 and directed back towards the first side portion 30.

The building construction panel 20 further comprises a rib member 50 secured to each of the opposed front and back portions 26,28 of the sheet metal outer skin 24 so as to span therebetween in bracing relation. The rib member 50 extends substantially the length "L" of the main body portion 22, and preferably extends the entire length of the main body portion 22. The rib member 50 is of substantially constant cross-section along its length. The shape of the cross-section of the rib member 50 may be chosen from the group consisting of "Z"-shaped, as can be seen in FIGS. 2, and 3, or may be "C"-shaped, "I"-shaped, "V"-shaped, and "W"-shaped, as can be seen in FIGS. 8A through 8D, respectively. The rib member 50 could also be perforated or segmented, if desired, for the purpose of weight reduction.

During manufacture of the first preferred embodiment of the building construction panel 20, the second skin element 41 is placed horizontally with the back portion 28 resting on a suitable support and the the first and second side portions 30,32 and the rib member 50 projecting upwardly. Temporary inserts (not shown) are placed in substantially sealed relation with respect to the ends of the building construction panel 20, so as to in essence form an open-top reservoir into which a suitable foam insulation is poured.

Figure 4:
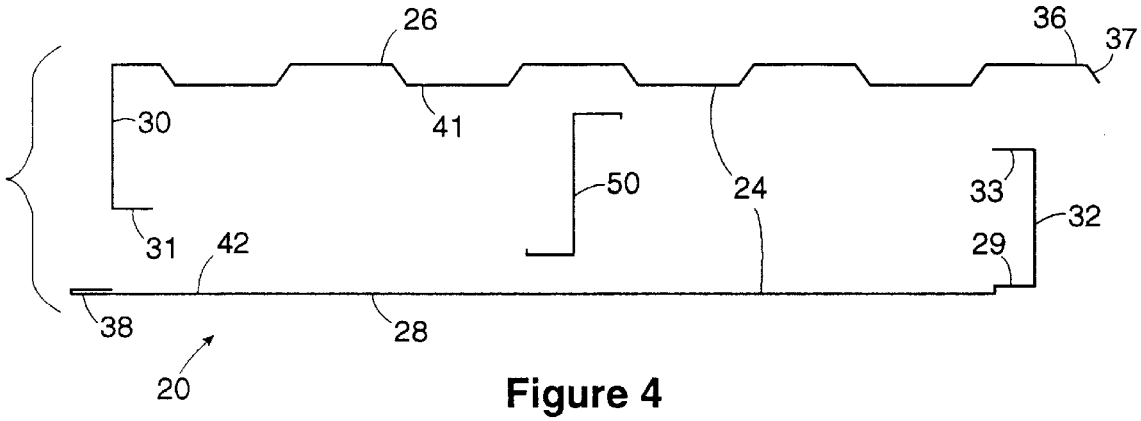
FIG. 4 is an exploded end view of a second preferred embodiment of the load bearing pre-fabricated building construction panel according to the present invention.
Figure 5:
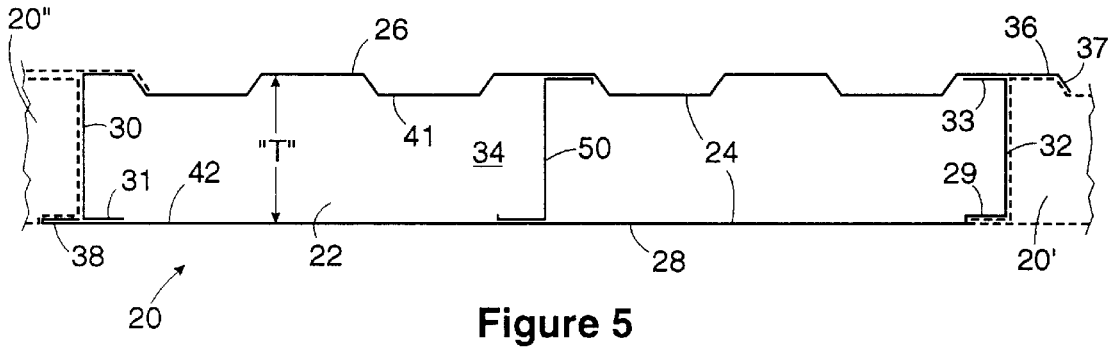
FIG. 5 is an end view of the load bearing pre-fabricated building construction panel of FIG. 4.
Figure 6:
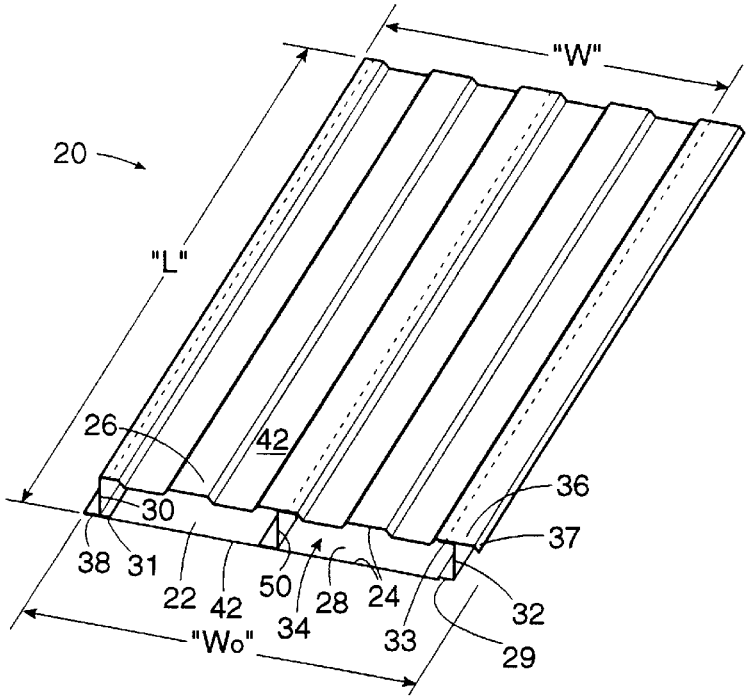
FIG. 6 is an isometric view from the end of the load bearing pre-fabricated building construction panel of FIG. 1.

Reference will now be made specifically to FIGS. 4 through 6, which show the second preferred embodiment of the building construction panel of the present invention. The second preferred embodiment is substantially similar to the first preferred embodiment and accordingly like reference numerals are used to designate like parts, for the sake of clarity; however, the following differences exist. In the second preferred embodiment of the building construction panel 20, the first skin element 41 includes the first side portion 30 of the sheet metal outer skin 24. The second skin element 42 no longer includes the first side portion 30, but still includes the second side portion 32 of the sheet metal outer skin 24. The first side portion 30 terminates in an adjoinment flange 31 oriented substantially parallel to the back portion 28 and directed back towards the second side portion 32, and the second side portion 32 terminates in an adjoinment flange 33 oriented substantially parallel to the front portion 26 and directed back towards the first side portion 30.

Figure 7:
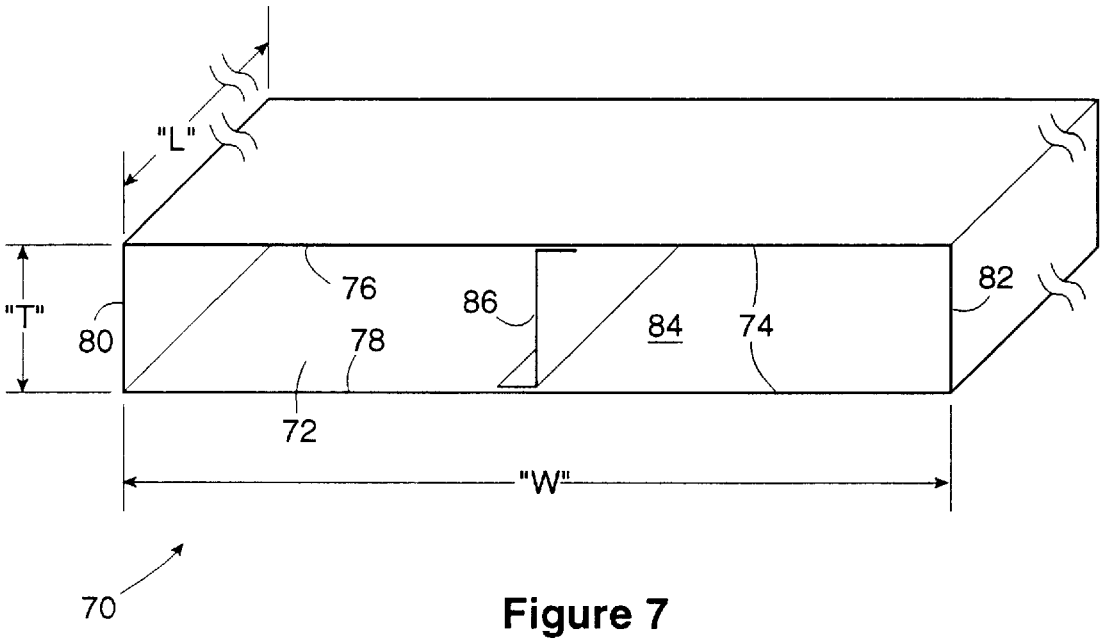
FIG. 7 is an end view of an alternative embodiment of the load bearing pre-fabricated building construction panel according to the present invention.
Figure 8A:
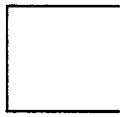
FIGS. 8A through 8D are end views of alternative embodiments of a rib member used in the various embodiments of the load bearing pre-fabricated building construction panel of the present invention.
Figure 8B:
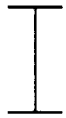
Figure 8C:
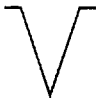
Figure 8D:
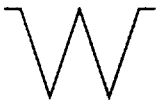

Reference will now be made specifically to FIG. 7, which shows an alternative embodiment load bearing prefabricated building construction panel 70. As in the first and second preferred embodiments, the alternative embodiment building construction panels 70 may be connected to a next substantially similarly oriented building construction panel 70 in first side to second side relation. The alternative embodiment building construction panel 70 illustrated in FIG. 7 comprises a main body portion 72 having length "L", thickness "T", and width "W". A sheet metal outer skin 74 is disposed substantially at the exterior of the main body portion and has opposed front and back portions 76,78 adjoined by first and second side portions 80,82 to form a substantially hollow core 84, with an insulative material disposed within the substantially hollow core 84. A rib member 86 is secured to each of the front and back portions 76,78 of the sheet metal outer skin 74 so as to span therebetween in bracing relation. The rib member 86 extends substantially the length "L" of the main body portion 72, and preferably extends the entire length "L" of the main body portion 72.

As can be seen in FIGS. 1 through 8, there are a multiplicity of parts uniquely configured to form this structural panel invention and its use in creating a framework of two or more panels for wall, floor, and roof systems. The upper or top skin element of the structural panel consists of galvanized steel with corrugation of a specified type. This top sheath or sheet of steel is returned to spec, creating a plate which is later stitch welded to the corresponding bottom or lower skin of this panel. This lower skin is also returned to a given spec, creating a plate which is later stitch welded to corresponding upper or top skin at its inner surface, as also for the top skin return being welded to the inner surface of the bottom skim The other end of the bottom skin which has not been folded to form the return to be stitch welded to the top skin, is folded back onto itself; to form a rigid flange lap connector. This lap-connector member fits into the bottom sheet of the preceding coincident panel member wherein a designated indented slot exists to accommodate the lap-connector. Both the lap connector and the indentation run the full edge length of the panel member. Such is true for the plurality of all members. The return edge of the top sheath and the return edge of the bottom sheath are stitch welded to the inner surfaces of the corresponding bottom and top sheaths respectively. This effectively creates the shell formed by the top and bottom galvanized skins of this panel.

The top or upper sheath of steel of a panel extends at its non-returned end to form an elongated member, beyond the stitch welded section formed by the return member of the bottom sheath and the inner surface to the top sheath. This extended top sheath member overlaps per defined spec onto the corrugated matching upper surface of the coincident top sheath of the abutting panel, along the entire length of both panels being joined at a later stage to form a panel structure of two or more panels. When fastening occurs between two panels, a multiplicity of threaded self sealing TEK screws are deployed per defined spec.

A significant innovation is deployed in this invention in the form of a continuous member galvanized steel "Z" or "C" section, which is placed in the centre of the panel, running the entire length of the panel from end to end. This member is stitch welded along the outer surfaces of the top and bottom parts of the "Z", to the inner surfaces of the upper steel sheath and the lower steel sheath, along the entire length of the panel. This "Z" or "C" section creates tremendous incremental structural strength in this panel when compared to all other comparable composite steel surface and polymer core panels including those described in the aforementioned patents. The test specifications achieved in prescribed wall, floor, and roof configurations surpass all other panels.

This structural panel when used for wall and roof applications is corrugated and is built to a specified or predetermined depth or thickness. For floor applications these specs are modified to provide additional load bearing capacities both dynamic and static. The urethane fire retardant core is of high density, which is adapted to varying specifications depending on application and panel thickness. This urethane core fills fully all the spaces and vacant interstices within the panel once the continuous member steel "Z" or "C" section has been placed and secured to the top and bottom steel sheaths of the panel, such as by stitch welding.

The bottom and top sheath returns of the panel are stitch welded to the inner surfaces of the top and bottom steel sheaths respectively.

To interconnect and interlock two or more panels, the design embodiments as described above are utilized as follows, where each individual panel construction is a unitary structure. For the top edge connection for a panel system of two or more panels, the elongated member of the top skin of a panel which overlaps the corrugated top edge of the coincident abutting panel, along the entire length of both the panels and along the entire coincident edge, is fastened with threaded self sealing TEK screws or other fastening devices, at defined intervals. For the bottom edge connection for this panel system, at the bottom skin of the panels to be joined the special reinforced flange member of one panel fits into the indented section of the mating coincident panel, along the entire length of the abutting edges of both panels and is secured through three layers of steel by threaded self securing TEK screws or other fastening devices, at defined intervals.

The application described herein deals with an integrated steel load bearing structural system panel, specifically designed for the building of load bearing structural walls, roofs and floors. Such a panel is designated in the industry as an ISS Panel. However, such a panel in keeping with the present invention has several unique design features in both its basic construction which give it superior load bearing structural strength compared to other current designs, and in its reinforced external panel-to-panel edge connection mechanism necessary for the construction of both load bearing structural wall, roof and floor sections. Finally, the ISS Panel has additional features specific to its use as a load bearing structural panel wherein it has superior rigidity with less deflection characteristics, and has specific features for its use as a structural floor element wherein it has enhanced load-bearing capabilities Other modifications and alterations may be used in the design and manufacture of the apparatus of the present invention without departing from the spirit and scope of the accompanying claims.

What is claimed is:

1. A load bearing pre-fabricated building construction panel; wherein said building construction panel is load being and is applicable for use in floor, wall, and roof construction, and wherein said building construction panel is connectable to a next substantially similarly oriented building construction panel in first side to second side relation; said building construction panel comprising:

a main body portion having length "L", thickness "T", and width "W";

a sheet metal outer skin disposed substantially at the exterior of said main body portion and having opposed front and back portions adjoined by first and second side portions to form a substantially hollow core; wherein said opposed front and back portions comprise first and second skin elements, respectively, and wherein said front skin element of said building construction panel is corrugated;

said first side portion of said building construction panel spanning between said opposed front and back portions at a first edge of said building construction panel, and comprising an inwardly facing "C" or "Z" section;

said second side portion of said building construction panel spanning between said opposed front and back portions at a second edge of said building construction panel, and comprising an inwardly facing "C" section;

an insulative material disposed within said substantially hollow core;

a first substantially rigid overlapping securing flange extending sidewardly from said front portion of said building construction panel past said first side portion, for flush fastening in overlapping relation with no separation to a first adjacent building construction panel of similar orientation;

a second substantially rigid overlapping securing flange extending sidewardly from said back portion of said building construction panel past said second side portion, for flush fastening in overlapping relation with no separation to a second adjacent building construction panel of similar orientation;

wherein said first side of said building construction panel is adapted to be connected flush to said second side of said adjacent building construction panel, with no separation;

wherein said building construction panel, including said first and second substantially rigid overlapping securing flanges, has an overall width "$W_o$"; and wherein said building construction panel exhibits load bearing characteristics at least in part due to the presence of said corrugated front skin element thereof; and wherein said building construction panel exhibits further load bearing characteristics at least in part due to the respective first and second sides thereof being adapted to be connected flush to adjacent ones of said building construction panel.

2. The load bearing pre-fabricated building construction panel of claim 1 wherein said second substantially rigid overlapping securing flange is disposed substantially parallel to said back portion of said building construction panel, and further comprises an offset portion formed in said back portion and disposed along the length of said back portion of said building construction panel for receiving therein a second substantially rigid overlapping securing flange of said second adjacent building construction panel.

3. The load bearing pre-fabricated building construction panel of claim 1, wherein said first substantially rigid overlapping securing flange is disposed substantially parallel to said front portion of said building construction panel.

4. The load bearing pre-fabricated building construction panel of claim 3, wherein said first substantially rigid overlapping securing flange terminates in an angled lip portion to follow the corrugation of said front skin element of said first adjacent building construction panel.

5. The load bearing pre-fabricated building construction panel of claim 1, wherein said first skin element includes said second side portion of said sheet metal outer skin and said second skin element includes said first side portion of said sheet metal outer skin.

6. The load bearing pre-fabricated building construction panel of claim 5, wherein said first side portion terminates in an adjoinment flange oriented substantially parallel to said front portion and directed toward said second side portion, and said second side portion terminates in an adjoinment flange oriented substantially parallel to said back portion and directed toward said first side portion.

7. The load bearing pre-fabricated building construction panel of claim 1, wherein said second skin element includes said first and second side portions of said sheet metal outer skin.

8. The load bearing pre-fabricated building construction panel of claim 7, wherein said first side portion terminates in an adjoinment flange substantially parallel to said front portion and directed toward said second side portion, and said second side portion terminates in an adjoinment flange substantially parallel to said front portion and directed toward said first side portion.

9. The load bearing pre-fabricated building construction panel of claim 8, wherein said second substantially rigid overlapping securing flange is formed by folding said second skin element onto itself.

10. The load bearing pre-fabricated building construction panel of claim 1, further comprising a rib member secured to each of said opposed front and back portions of said sheet metal outer skin so as to span therebetween in bracing relation, and extending substantially the length "L" of said main body portion.

11. The load bearing pre-fabricated building construction panel of claim 10, wherein said rib member is of substantially constant cross-section along its length.

12. The load bearing pre-fabricated building construction panel of claim 11, wherein the shape of said cross-section of said rib member is chosen from the group consisting of "Z"-shaped, "C"-shaped, "I"-shaped, "V"-shaped, and "W"-shaped.

13. The load bearing pre-fabricated building construction panel of claim 1, wherein said first and second skin elements and said first and second side portions are secured together by an adhesive so as to provide a thermal barrier between said first and second skin elements.

14. A load bearing pre-fabricated building construction panel; wherein said building construction panel is load bearing and is applicable for use in floor, wall, and roof construction, and wherein said building construction panel is connectable to a next substantially similarly oriented building construction panel in first side to second side relation; said building construction panel comprising:

a main body portion having length "L", thickness "T", and width "W";

a sheet metal outer skin disposed substantially at the exterior of said main body portion and having opposed front and back portions adjoined by first and second side portions to form a substantially hollow core; wherein said opposed front and back portions comprise first and second skin elements, respectively, and wherein sad front ski element of said building construction panel is corrugated;

said first side portion of said building construction panel spring between said opposed front and back portions at a first edge of said building construction panel, and comprising an inwardly facing "C" or "Z" section;

said second side portion of said building construction panel spanning between said opposed front and back portions at a second edge of said building construction panel, and comprising an inwardly facing "C" section;

an insulative material disposed within said substantially hollow core;

a first substantially rigid overlapping securing flange extending outwardly from said front portion of said building construction panel past said first side portion, for flush fastening in overlapping relation with no separation to a first adjacent building construction panel of similar orientation;

a second substantially rigid overlapping securing flange extending outwardly from said back portion of said building construction panel past said second side portion, for flush fastening in overlapping relation with no separation, to a second adjacent building construction panel of similar orientation;

wherein said first side of said building construction panel is adapted to be connected flush to said second side of said adjacent building construction panel, with no separation;

wherein said building construction panel, including said first and second substantially rigid overlapping securing flanges, has an overall width "$W_o$";

wherein said building construction panel exhibits load bearing characteristics at least in part due to the presence of said corrugated front skin element thereof; and wherein said building construction panel exhibits further load bearing characteristics at least in part due to the respective first and second sides thereof being adapted to be connected flush to adjacent ones of said building construction panel; and wherein said first side portion terminates in an adjoinment flange oriented substantially parallel to said front portion and directed toward said second side portion, and said second side portion terminates in an adjoinment flange oriented substantially parallel to said back portion and directed toward said first side portion.

15. The load bearing pre-fabricated building construction panel of claim 14, wherein said first and second skin element and said first and second side portions are secured together by an adhesive so as to provide a thermal barrier between said first and second skin elements.

16. A load bearing pre-fabricated building construction panel; wherein said building construction panel is load bearing and is applicable for use in floor, wall, and roof construction, and wherein said building construction panel is connectable to a next substantially similarly oriented building construction panel in first side to second side relation; said building construction panel comprising:

a main body portion having length "L", thickness "T", and width "W";

a sheet metal outer-skin disposed substantially at the exterior of said main body portion and having opposed front and back portions adjoined by first and second side portions to form a substantially hollow core; wherein said opposed front and back portions comprise first and second skin elements, respectively, and wherein said front skin element of said building construction panel is corrugated;

said first side portion of said building construction panel spanning between said opposed front and back portions at a first edge of said building construction panel, and comprising an inwardly facing "C" or "Z" section;

said second side portion of said building construction panel spanning between said opposed front and back portions at a second edge of said building construction panel, and comprising an inwardly facing "C" section;

an insulative material disposed within said substantially hollow core;

a first substantially rigid overlapping securing flange extending outwardly from said front portion of said building construction panel past said first side portion, for flush fastening in overlapping relation with no separation to a first adjacent building construction panel of similar orientation;

a second substantially rigid overlapping securing flange extending outwardly from said back portion of said building construction panel past said second side portion, for flush fastening in overlapping relation with no separation to a second adjacent building construction panel of similar orientation;

wherein said first side of said building construction panel is adapted to be connected flush to said second side of said adjacent building construction panel, with no separation;

wherein said building construction panel including said first and second substantially rigid overlapping securing flanges, has an overall width "$W_o$";

wherein said building construction panel exhibits load bearing characteristics at least in part due to the presence of said corrugated front skin element thereof; and wherein said building construction panel exhibit further load bearing characteristics at least in part due to the respective first and second sides thereof being adapted to be connected flush to adjacent ones of said building construction panel; and wherein said first side portion terminates in an adjoinment flange substantially parallel to said front portion and directed toward said second side portion, and said second side portion terminates in an adjoinment flange substantially parallel to said front portion and directed toward said first side portion.

17. The load bearing pre-fabricated building construction panel of claim 16, wherein said first and second skin elements and said first and second side portions are secured together by an adhesive so as to provide a thermal barrier between said first and second skin elements.

* * * * *